US005415225A

United States Patent [19]

Randlett et al.

[11] Patent Number: 5,415,225

[45] Date of Patent: May 16, 1995

[54] HEAT EXCHANGE TUBE WITH EMBOSSED ENHANCEMENT

[75] Inventors: Myron R. Randlett, Cuba, Mo.; Ralph L. Webb, State College, Pa.

[73] Assignee: Olin Corporation, Cuba, Mo.

[21] Appl. No.: 167,556

[22] Filed: Dec. 15, 1993

[51] Int. Cl.[6] ..... F28F 1/36

[52] U.S. Cl. ..... 165/133; 165/184

[58] Field of Search ..... 165/133, 179, 181, 184; 138/38; 29/890.046, 890.048, 890.049

[56] References Cited

U.S. PATENT DOCUMENTS

| | | | |
|---|---|---|---|
| 2,978,797 | 4/1961 | Ekelund | 165/179 |
| 3,457,990 | 7/1969 | Theophilos et al. | 165/133 |
| 3,496,752 | 2/1970 | Kun et al. | 165/133 |
| 3,696,861 | 10/1972 | Webb | 165/133 |
| 3,768,290 | 10/1973 | Zatell | 165/133 X |
| 3,789,915 | 2/1974 | Ford | 165/1 |
| 3,850,227 | 11/1974 | Ford | 165/1 |
| 3,861,462 | 1/1975 | McLain | 165/179 |
| 3,885,622 | 5/1975 | McLain | 165/179 |
| 3,902,552 | 9/1975 | McLain | 165/179 |
| 3,906,604 | 9/1975 | Kakizaki et al. | 29/890.045 |
| 3,906,605 | 9/1975 | McLain | 29/890.045 |
| 3,991,822 | 11/1976 | Morris | 165/140 |
| 4,044,797 | 8/1977 | Fujie et al. | 138/38 |
| 4,059,147 | 11/1977 | Thorne | 165/133 |
| 4,166,498 | 9/1979 | Fujie et al. | 165/733 |
| 4,194,384 | 3/1980 | Fujie et al. | 72/325 |
| 4,195,688 | 4/1980 | Fujie et al. | 165/133 |
| 4,216,826 | 8/1980 | Fujikake | 165/133 |
| 4,223,539 | 9/1980 | Webb et al. | 165/179 X |
| 4,246,960 | 1/1981 | Popplewell et al. | 165/134.1 |
| 4,275,784 | 6/1981 | Popplewell et al. | 165/134.1 |
| 4,330,036 | 5/1982 | Satoh et al. | 165/179 |
| 4,425,942 | 1/1984 | Hage et al. | 138/38 |
| 4,438,807 | 3/1984 | Mathur et al. | 165/133 |
| 4,602,681 | 7/1986 | Daikoku et al. | 165/133 |
| 4,621,953 | 11/1986 | McGuth | 138/39 X |
| 4,653,163 | 3/1987 | Kuwahara et al. | 29/890.05 |
| 4,658,892 | 4/1987 | Shinohara et al. | 165/133 |
| 4,660,630 | 4/1987 | Cunningham et al. | 165/133 |
| 4,674,566 | 6/1987 | Heine et al. | 165/134.1 |
| 4,678,029 | 7/1987 | Sasaki et al. | 165/133 |
| 4,705,103 | 11/1987 | Zogg et al. | 165/110 |
| 4,733,698 | 3/1988 | Sato | 138/38 |
| 4,995,549 | 2/1991 | Hellman, Sr. | 228/147 |
| 5,052,476 | 10/1991 | Sukumoda et al. | 165/133 |
| 5,070,937 | 12/1991 | Mougin et al. | 165/133 |
| 5,184,674 | 2/1993 | Keyes | 165/184 |
| 5,203,403 | 4/1993 | Yokoyama et al. | 165/151 |
| 5,259,448 | 11/1993 | Masukawa et al. | 165/133 |
| 5,361,828 | 11/1994 | Lee et al. | 165/133 X |

FOREIGN PATENT DOCUMENTS

| | | | |
|---|---|---|---|
| 148609 | 6/1988 | European Pat. Off. . | |
| 29997 | 2/1984 | Japan | 165/133 |
| 216190 | 10/1985 | Japan | 165/179 |
| 143696 | 7/1986 | Japan | 165/184 |
| 108411 | 10/1988 | Japan . | |
| 87036 | 3/1989 | Japan | 29/890.048 |

OTHER PUBLICATIONS

"Development of Various High Efficiency Heat Transfer Copper Tubing" by Shinohara (Hitachi Cable, Ltd. Japan) appearing in International Wrought Copper Council. May 22, 1990 (Paper No. 13).

*Primary Examiner*—John Rivell
*Assistant Examiner*—L. R. Leo
*Attorney, Agent, or Firm*—Gregory S. Rosenblatt

[57] ABSTRACT

There is provided heat exchange tube formed from a ductile metal strip which is formed into a generally circular configuration with the opposing longitudinal edges of the strip welded together. Both surfaces of the strip are enhanced. On one surface, the enhancement constitutes parallel rows of vertical fins separated by channels. Conduits which run along the channels and are located at the base of one side of the fins facilitate bending of the fins about the fin base to form a nucleate boiling surface. On the opposing surface of the tube, the enhancement constitutes parallel rows of protrusions separated by a distance effective to generate turbulence in a fluid passing along the second surface. In a preferred embodiment, the protrusions are in the form of truncated cones.

12 Claims, 5 Drawing Sheets

HEAT EXCHANGE TUBE WITH EMBOSSED ENHANCEMENT

FIELD OF THE INVENTION

This invention relates to heat exchange surfaces. More particularly, a welded metal tube is enhanced on two opposing surfaces. Parallel rows of fins are formed on one surface. The opposing surface contains protrusions effective to generate planar surface turbulence in a fluid.

BACKGROUND OF THE INVENTION

In certain refrigeration and air conditioning applications, a heat exchange unit has a liquid refrigerant flowing within a tube while the fluid to be cooled flows externally over the tube. Liquid refrigerants such as trichloromonofluoromethane or dichlorodifluoromethane flow through the tube. As the liquid refrigerant absorbs heat from the external liquid, the refrigerant is changed to a gas. The gas phase refrigerant is returned to a compressor, compressed to a liquid and returned to the heat exchange tube for another cycle.

One method to form the tubes involves passing a metallic strip through forming rolls to transform the strip into an ellipsoid with longitudinal edges adjacent one another. The edges are then welded together to form a tube. This process is disclosed in U.S. Pat. No. 4,995,549 to Hellman, Sr., which is incorporated by reference in its entirety herein.

To increase the efficiency of heat transfer through the tube, the inner or outer surface of the tube may be enhanced. Enhancements consist of fins, protrusions or other shapes which increase the surface area. A plurality of parallel fins is disclosed in U.S. Pat. No. 4,658,892 to Shinohara et al. while truncated pyramids are disclosed in U.S. Pat. No. 5,070,937 to Mougin et al., both of which are incorporated by reference in their entirety herein.

Another method to increase the heat transfer is by facilitating nucleate boiling. As the refrigerant changes state from a liquid to a vapor, a large quantity of heat is absorbed from the fluid. In nucleate boiling, liquid adjacent to a trapped vapor bubble is super heated by the heat exchange surface. Heat is transferred to the bubble at the liquid vapor interface. The bubble grows in size until surface tension forces are overcome by buoyancy and the bubble breaks free from the surface. As the bubble leaves the surface, fresh liquid wets the now vacated area. The remaining liquid absorbs heat from the tube surface to form the next bubble. The vaporization of liquid and continuous stripping of the heated liquid adjacent to the heat transfer surface, together with the convection effect due to the agitation of the liquid pool by the bubbles, results in an improved heat transfer rate for the heat exchange surface.

One effective nucleate boiling site is a channel adjacent to a surface of the heat exchange tube for transport of the liquid. This channel has narrow openings through which the vapor bubbles escape. The openings are sufficiently small to effectively retain the trapped vapor bubbles until super heated.

The manufacture of nucleate boiling sites is disclosed in U.S. Pat. Nos. 3,696,861 to Webb and 4,059,147 to Thorne. Fins are formed on a heat exchange surface and then bent such that the tip of one fin is in close proximity to a mid-point of an adjacent fin. A channel is formed at the base of the fins and a narrow aperture sufficiently small to promote and sustain nucleate boiling of a fluid forms where a fin tip abuts an adjoining fin. Both the Webb and the Thorne patents are incorporated in their entirety by reference herein.

One method of enhancing a tube is to emboss a desired pattern into the metallic strip prior to forming the strip into a tube. The longitudinal edges of the enhanced strip are then welded together. U.S. Pat. Nos. 3,861,462 and 3,902,552, both to McLain and both incorporated by reference in their entireties herein, disclose the use of textured rolls to emboss a pattern into the metallic strip. A desired texture may be formed on one or both sides of the strip.

Whether the fins are formed by rollers embossing the outside of a tube or textured rolls embossing a strip which is subsequently formed into a tube, the fins are tapered. The fins are thicker at the fin root than at the fin tip. Also, the merge between the fin root and the outside wall of the tube is at a substantial radius. Both the taper and the radius strengthen the fin root. As a result, when the fin is bent to form a nucleate boiling surface, the bend is about a mid-portion of the fin rather than at the fin root.

A problem with present heat exchange tubes are the difficulty with providing an accurate bend in all fins having the same arc and the same radius so that the heat transfer coefficient of the tube is predictable and repeatable. Another problem is that the super heated vapor bubbles are pressurized and interfere with the flow of fluid through the channels reducing the heat transport capability.

SUMMARY OF THE INVENTION

Accordingly, it is an object of the invention to provide a heat transfer surface and a heat exchange tube which do not have the disadvantages of the prior art. It is a feature of the invention that the heat transfer surface has a plurality of vertical fins separated by channels. A conduit formed at the base of one side of each fin provides a point at which the fin may be bent at the root rather than a mid-point. These conduits may also form a capillary tube drawing liquid into the channels between fins notwithstanding the presence of a pressurized vapor bubble. It is another feature of the invention that the opposing side of the heat transfer surface may contain protrusions separated by a distance effective to generate horseshoe turbulence in a fluid. Yet another feature of the invention is that these enhancements may be formed on either wall of the tube, dependent on whether an absorption tube or a evaporation tube is desired.

It is an advantage of the invention that the conduit promotes bending of the fins in a uniform manner at the fin root. It is another advantage of the invention that when the protrusions are in the form of truncated cones, horseshoe turbulence along the surface of the heat exchange tube is maximized with minimal turbulence in a direction perpendicular to the walls of the heat exchange surface. Yet another advantage of the invention is that both surface enhancements may be introduced to a metallic strip by embossing. The embossed substrate may be a strip which is formed into a generally circular configuration with either enhancement as an outer surface. The longitudinal strip edges are welded to form an enhanced heat exchange tube.

In accordance with the invention, there is provided a heat exchange surface. The heat exchange surface has a substrate with an enhancement. The enhancement constitutes substantially parallel rows of vertical fins separated by channels. Conduits run along the channels parallel to the fins. The conduits are located at the base of one side of the fins.

In accordance with a second embodiment of the invention, there is provided a heat exchange tube. The tube is formed from a ductile strip which is shaped into a generally circular configuration with the opposing longitudinal edges welded together to form a tube. The tube has opposing first and second surfaces. A first enhancement is formed on a first surface of the heat transfer tube. This first enhancement constitutes substantially parallel rows of vertical fins separated by channels. Conduits run along the grooves parallel to the fins. The conduits are located at the base of one side of the fins. A second enhancement is formed on a second surface of the tube. The second enhancement constitutes parallel rows of protrusions separated by a distance effective to generate turbulence in a fluid passing along the second surface.

The above stated objects, features and advantages will become more apparent from the specification and drawings which follow.

IN THE DRAWINGS

DETAILED DESCRIPTION

Figure 1:
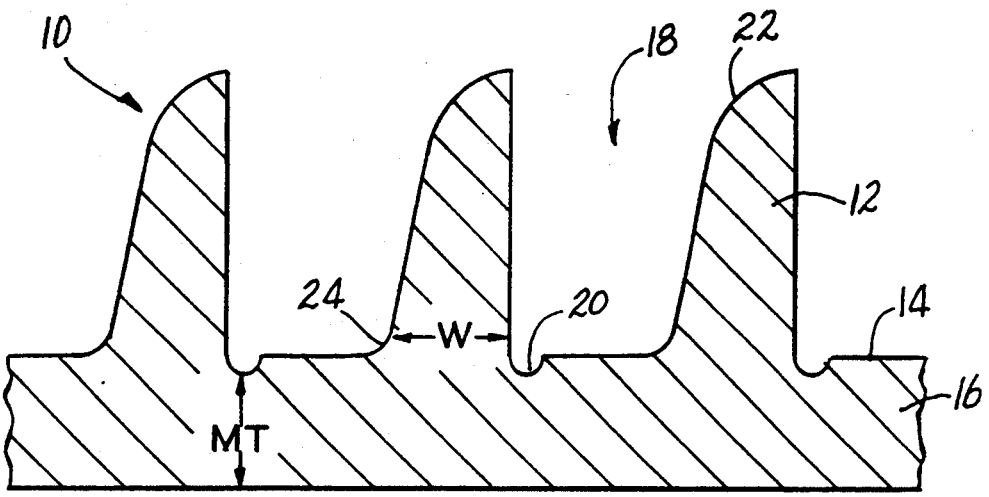
FIG. 1 shows in cross sectional representation the vertical fins of the invention.

FIG. 1 illustrates in cross sectional representation a heat exchange surface 10 in which the enhancement is a plurality of substantially parallel rows of vertical fins 12. The fins 12 are formed in a first surface 14 of a substrate 16. The substrate 16 is formed from any ductile material which has good thermal conductivity such as a metal or metal alloy. Among the preferred materials are copper and copper alloys, aluminum and aluminum alloys, titanium and titanium alloys and stainless steels. Most preferred are copper and copper alloys such as that alloy designated by the Copper Development Association as C122 (deoxidized copper having the nominal composition: 99.9% copper and 0.015–0.040% phosphorous).

The fins 12 are preferably formed by embossing as disclosed in U.S. patent application Ser. No. 08/093,544 entitled "Heat Exchange Tube and Method of Manufacture" by Randlett et al, which was filed on Jul. 16, 1993 which is incorporated by reference in its entirety herein now U.S. Pat. No. 5,388,329. The substrate 16 is passed through a rolling mill having a set of rolls, at least one of which is textured. The texture is in the form of a plurality of roll teeth separated by grooves. The roll teeth penetrate and deform the substrate 16 forming channels 18. The roll teeth further contain a means to form a bend locator 20 at the base of one side of the fin. As a result, the fins are formed to an asymmetric fin shape that is easily bent to one side as detailed below.

The metal from substrate 16 displaced by the roll teeth flows into roll grooves to form fins 12. The shape of the grooves dictates the shape of the fins. The fins may be any desired shape such as a truncated pyramid or trapezoidal base terminating at a knife edge.

One preferred fin shape includes a radius 22 at the tip of the fin opposite the first surface 14. The radius 22 is in a direction such that the fin tip is an off center arc and the fin is longer on the side adjacent the conduit than the side opposite the conduit. Further asymmetry is introduced into the fins by the radius 22 further promoting uniform bending.

The height of the fin 12 is dictated by the intended application. If the first surface 14 is to form the outside wall of a heat exchange tube and the fins are not bent to a nucleate boiling configuration, the fin height is limited by the amount of metal which can be displaced during embossing without tearing of the fins 12 or fracture of the substrate 16. For copper and copper alloys, maximum metal flow is achieved when the maximum crystalline grain size is about 0.050 millimeters and preferably, the average grain size is from about 0.015 mm to about 0.030 mm. Additionally, a lubricant such as polyethylene glycol applied as a mist directly to the rolling mills reduces friction and increases fin height.

The fin height is dependent on both the fin thickness and the fin pitch. When the fins have a nominal thickness of 0.20 mm (0.008 inch) with a nominal pitch of 56 fins/inch, a typical fin height is from about 0.38 mm to about 1.3 mm (0.015–0.050 inch). A more preferred fin height is from about 0.51 mm to about 1.0 mm (0.020 inch–0.040 inch) and most preferably, from about 0.64 mm to about 0.89 mm (0.025–0.035 inch). When the fins have a nominal thickness of 0.13 mm (0.005 inch) and a nominal pitch of 66 fins/inch, a preferred fin height is from about 0.30 mm to about 0.45 mm (0.012 inch–0.018 inch).

The width, "W" of base 24 of a fin 12 is from about 25% to about 50% of the height of the fin to prevent tearing of the fin during embossment forming.

One preferred bend locator is a conduit. The conduits 20 have a width equal to from about 5% to about 20% of the width of a channel 18 and preferably, from about 8% to about 12% of the width of the channel. The maximum depth of the conduit is generally about equal to one half the conduit width. The conduit depth is minimized since the conduit reduces the minimum tube wall thickness, "MT", thereby, reducing the maximum pressure which may be safely exposed to the tube. A preferred depth for the conduit 20 is from about 0.025 mm to about 0.075 mm (0.001 inch–0.003 inch).

Figure 2:
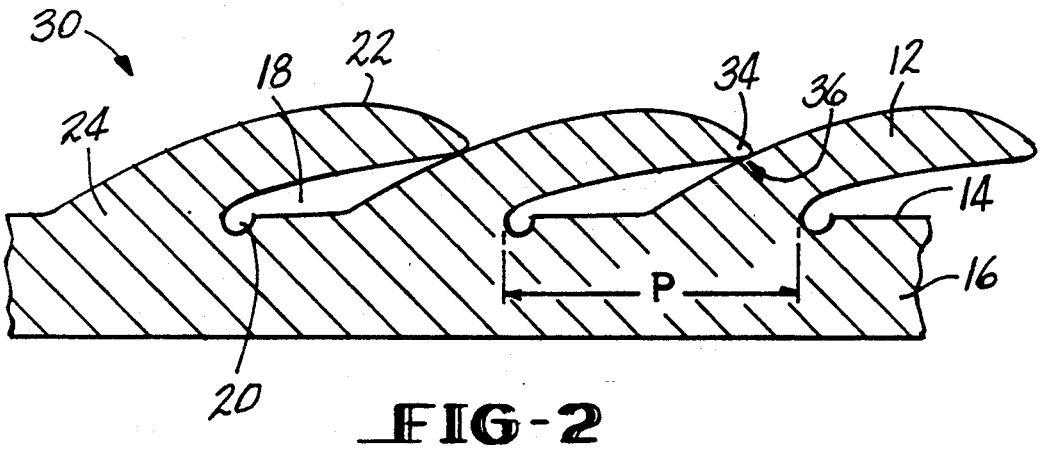
FIG. 2 shows in cross sectional representation the bending of the vertical fins of FIG. 1.

When the fins 12 are for a nucleate boiling configuration, the heat exchange surface 30 illustrated in FIG. 2 is applicable. The fins 12 are bent by any suitable means such as passing through a rolling mill. The fins 12 are bent so the tip 34 of one fin abuts, and preferably contacts, the mid-point 36 of an adjacent fin. When the substrate 16 is formed into a circular configuration, the fin tips separate slightly from the adjacent mid-point. Contacting the mid-point of an adjacent fin prior to forming into the circular configuration assures a uniform sized aperture is formed for nucleate boiling. The size of the aperture is determined by the diameter of the tube formed and subsequent sizing of the tube after forming. The larger the diameter of the tube, the smaller the formed apertures. Subsequent sizing of the tube such as by passing through sizing rolls is effective to fine tune the aperture size.

The bend locator 20 and the radius 22 facilitate fin bending. The bend locator 20 is formed to any shape effective to remove the radius from one side of the fin base 24, such as a hemispherical depression, a v-shaped notch or a right angle. The bend locator 20 causes each fin to deform at the fin base 24 when subjected to a deforming stress such as generated by a rolling mill. The radius 22 also promotes bending by ensuring that the force applied by the rolling mill is tangential to the first surface 14 of the substrate 16 rather than perpendicular to the first surface.

For the nucleate boiling embodiment, the preferred fin height is from about 0.38 mm to about 1.0 mm (0.015–0.040 inch) and preferably, from about 0.51 mm to about 0.64 mm (0.020–0.025 inch). The pitch, "P", the distance from a point on a fin 12 to the same point on an adjacent fin is slightly less than the fin height. This is so that when the fins bend over, the tip 34 of one fin will abut, and preferably contact, the mid-point 36 of an adjoining fin. Preferably, the pitch is from about 60% to about 95% of the fin height and more preferably, the pitch is from about 70% to about 90% of the fin height.

When the first surface 14 forms an inside wall of a heat exchange tube, similar unbent fin dimensions may be utilized with the additional provision that to reduce pressure loss within the tube, the ratio of the fin height to the inside diameter of the tube is less than about 0.04 and preferably, is in the range of from about 0.02 to about 0.03. When the fins are bent over, as in the nucleate boiling configuration, the pressure loss is not a concern and the fin height is independent of inside diameter of the tube. However, for ease of formability and bendability, fin heights similar to that used when the nucleate boiling surface is on the outside wall of the tube are utilized.

Figure 3:
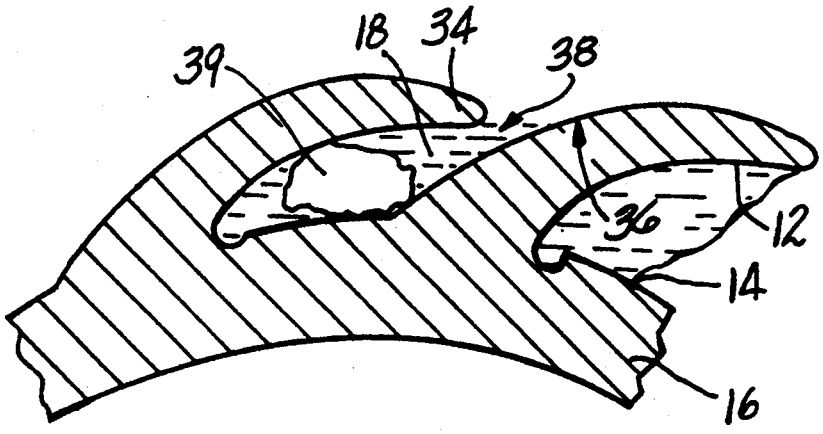
FIG. 3 shows in cross sectional representation the fins of FIG. 2 being opened to a nucleate boiling configuration by tube forming.

With reference to FIG. 3, when the substrate 16 is formed into a circular configuration for forming a welded tube and the first surface 14 constitutes the outside wall, the fins 16 separate slightly such the tip 34 of one fin and the mid-point 36 of an adjacent fin define a narrow aperture 38. Since the substrate is bent to a generally circular configuration, the radius of curvature at all points of the first surface 14 is about the same and the aperture 38 has a uniform width along the entire length and circumference of the welded tube.

Unlike other methods of forming the apertures, the present method separates the fin tips from the adjacent mid-points in a controlled fashion providing accurate and reproducible control of the aperture dimensions.

When the heat exchange surface 30 is utilized for nucleate boiling, a fluid flowing within channels 18 is heated to a temperature sufficient to generate vapor bubbles 39. As the vapor bubbles 39 become super heated, they expand and increase in internal pressure until they reach a critical size and are expelled through the aperture 38. As the vapor bubbles 39 expand and increase in pressure, they displace the fluid in the channel 18 reducing fluid contact with the heat transfer surface of the tube. In the tubes of the invention, however, the conduit 20 and channel 18 provide a mechanism for continued replenishment of fluid notwithstanding the presence of vapor bubbles 39 by capillary action in the narrow conduit.

Figure 4:
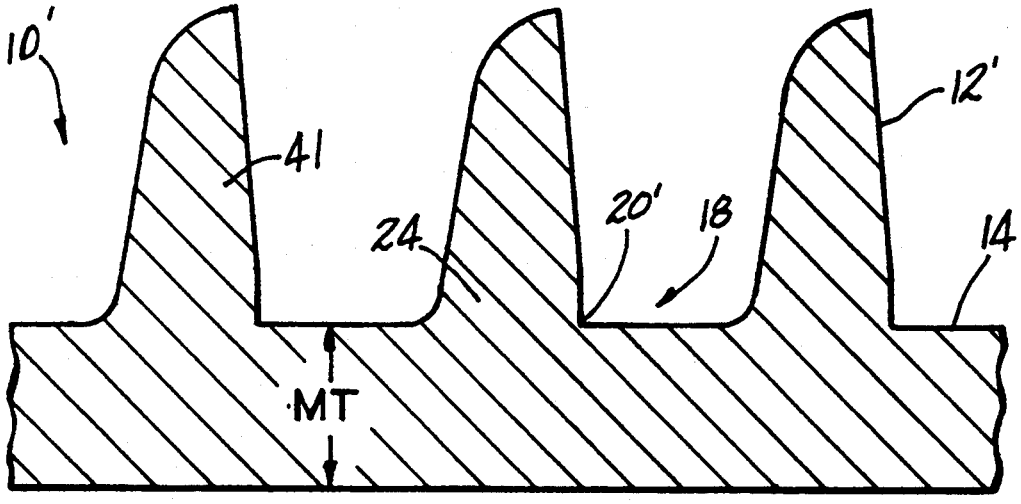
FIG. 4 shows in cross sectional representation the vertical fins of the invention in accordance with a second embodiment of the invention.

FIG. 4 illustrates in cross sectional representation another embodiment of the vertical fins 12' of the invention. Rather than a conduit as a bend locator, one edge of the fin base 24 is substantially perpendicular to the first surface 14. The remainder of the fin edge 41 has a slight taper to facilitate removal from the forming roll teeth. This embodiment has all the advantages achieved by the previous embodiment such as facilitating bending of the fin about the fin base with the further benefit that the minimum tube thickness, "MT", is not reduced by the conduit, 20'.

Figure 5:
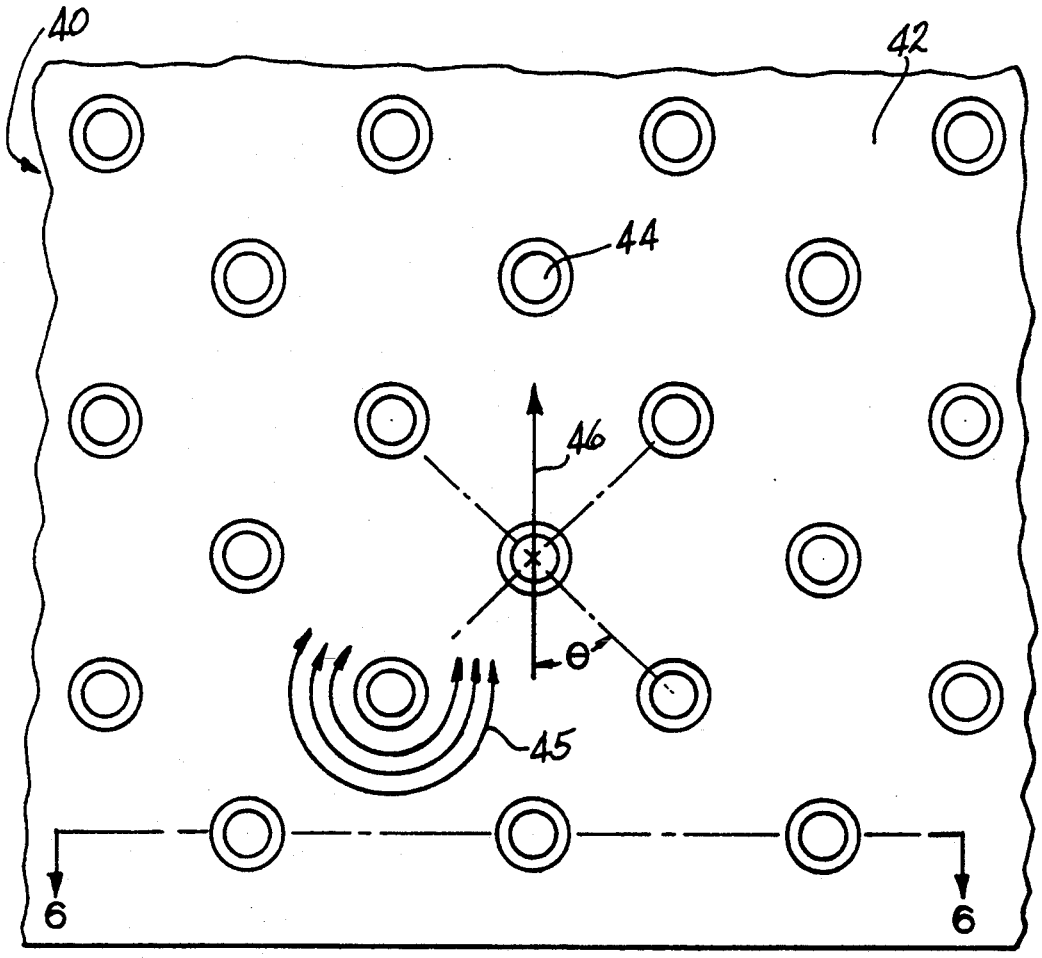
FIG. 5 shows in top planar view turbulence generating protrusions in accordance with the invention.

FIG. 5 illustrates in top planar view a heat exchange surface 40 for generating planar surface turbulence in a fluid passing along a second surface 42. A plurality of parallel rows of protrusions 44 are formed on the second surface 42 by any suitable means such as embossing. One suitable method of embossing is to pass a ductile substrate through a rolling mill having a set of rolls, at least one of which is textured. In one preferred embossing sequence, a first pass through a rolling mill generates both the vertical fins illustrated in either FIG. 1 or FIG. 4 and on the opposite side of the substrate, the protrusions 44 illustrated in FIG. 5. A second pass through a rolling mill bends the fins to form the nucleate boiling surface illustrated in FIG. 2. The protrusions 44 may take any desired shape such as pyramids, truncated pyramids, cones or truncated cones. Truncated cones are a preferred shape. The truncated cones maximize turbulence along the second surface 42 by generation of horseshoe vortexes as indicated by the arrows 45 representing the direction of fluid flow. The truncated cones also minimize turbulence in the direction perpendicular to the second surface 42.

Figure 6:
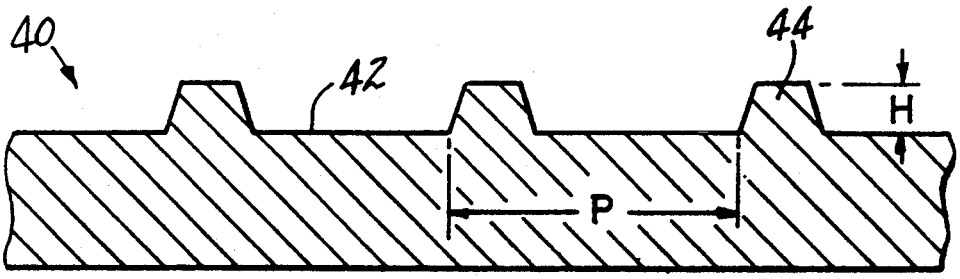
FIG. 6 shows in cross sectional representation the turbulence generating protrusions of FIG. 5.

FIG. 6 shows the heat exchange surface 40 in cross sectional representation. The ratio of the pitch "P" to the height, "H", of the protrusions 44 is from about 3 to about 7. More preferably, the ratio P:H is from about 4 to about 6. The height "H" is from about 0.38 mm to about 1.3 mm (0.015–0.050 inch) and preferably from about 0.54 mm to about 0.64 mm (0.020–0.025 inch). Increasing the height of the protrusions 44 increases turbulence, but as the distance to the second surface 42 increases, the benefit to the heat transfer coefficient decreases. Higher protrusions on an inside wall of the tube also cause a pressure drop in the fluid flowing through the tube.

Referring back to FIG. 5, when a fluid flows across the second surface 42, the protrusions 44 are preferably aligned such that the angle, $\theta$, between the direction of fluid flow as represented by arrow 46 and the rows of protrusions 44 is from about 40° to about 50° and preferably, approximately 45°. As shown in FIG. 5, when $\theta$ is 45°, the efficiency index (heat transfer enhancement ratio divided by friction increase ratio) is superior to when $\theta$ is on the order of 30°. FIG. 5 was generated from a computer model using a fluid with a Reynolds number of 30,000 and a fin height of 0.5 mm.

Figure 7:
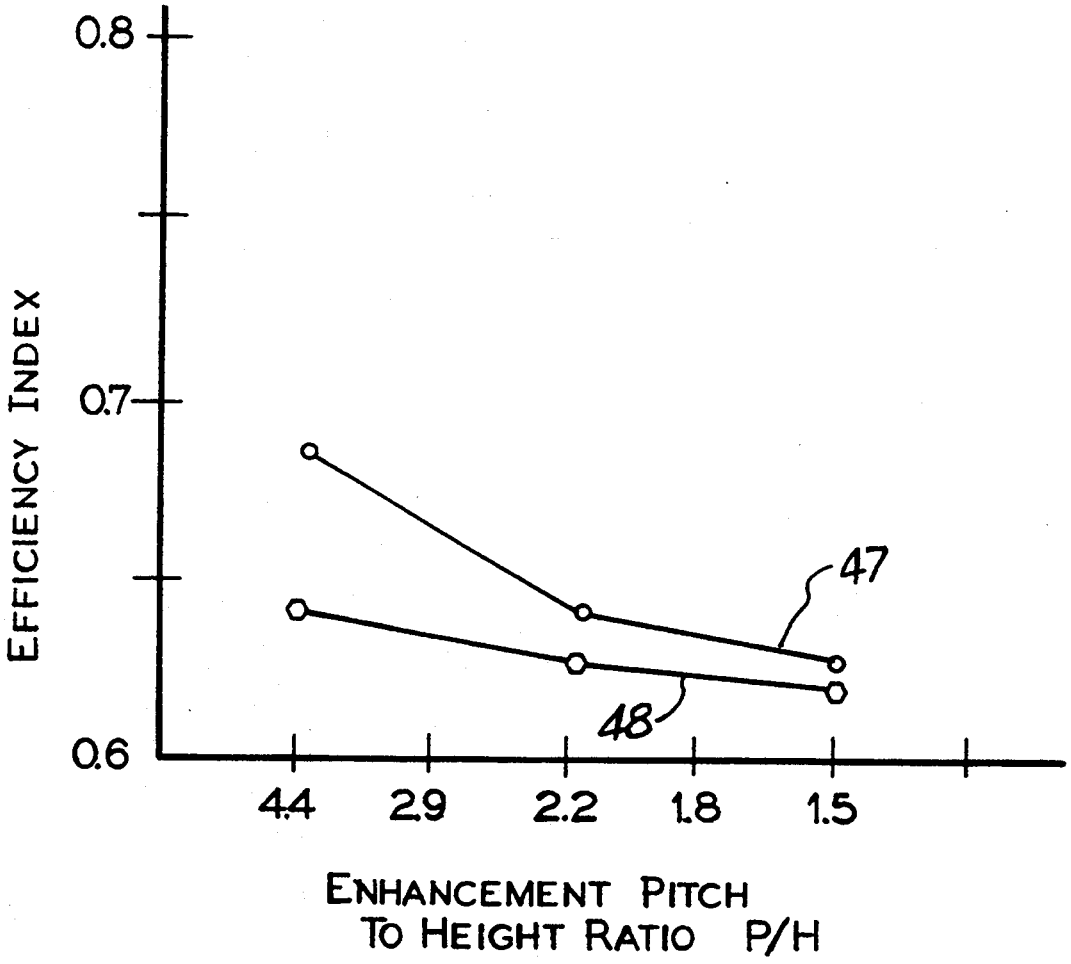
FIG. 7 shows in graphical representation the relationship between the heat transfer efficiency and the ratio of pitch to protrusion height.

FIG. 7 shows in graphical representation the improvement in the heat transfer efficiency index when $\theta$ is 45°, reference numeral 47 as compared to a $\theta$ of 30°, reference numeral 48. FIG. 7 also identifies the benefits achieved by having an enhancement pitch to height ratio, P:H, in excess of 3.0 and preferably, in excess of about 4.0.

Figure 8:
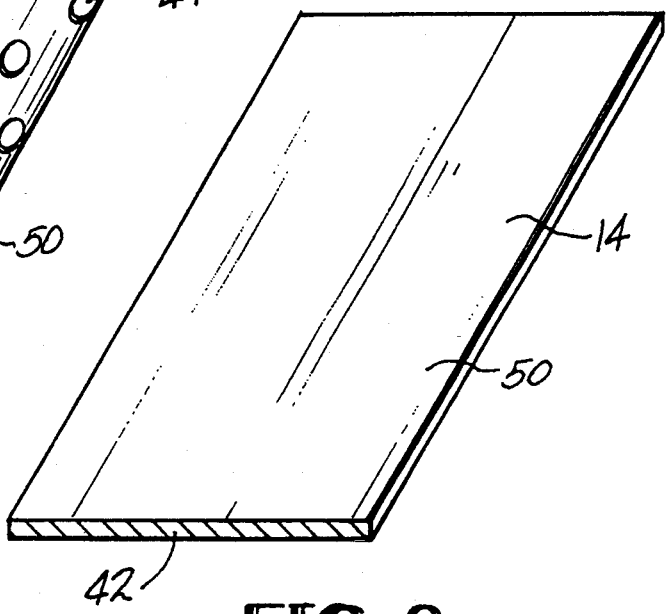
FIG. 8 shows in cross sectional representation a ductile metal strip for embossing with the enhancement patterns of the invention.

The heat transfer surfaces of the invention have particular utility for heat exchange tubes. Referring to FIG. 8, a heat exchange tube is formed by conventional means. A ductile strip 50, typically copper or a copper alloy, is formed with desired surface enhancements. A first surface 14 is formed with a first enhancement such as substantially parallel rows of vertical fins separated by channels with conduits running along the channels parallel to the fins and the conduits located at the base of one side of the fin as illustrated in FIG. 1. The fins may be bent over to form a nucleate surface as illustrated in FIG. 3. A second enhancement is formed on a second surface 42. The second enhancement may constitute parallel rows of protrusions separated by a distance effective to generate turbulence in a fluid passing along the second surface 42 as illustrated in FIG. 5.

The ductile strip is formed into a generally circular configuration with the opposing longitudinal edges of the strip welded together to form a tube having opposing first surface 14 and second surface 42.

Figure 9:
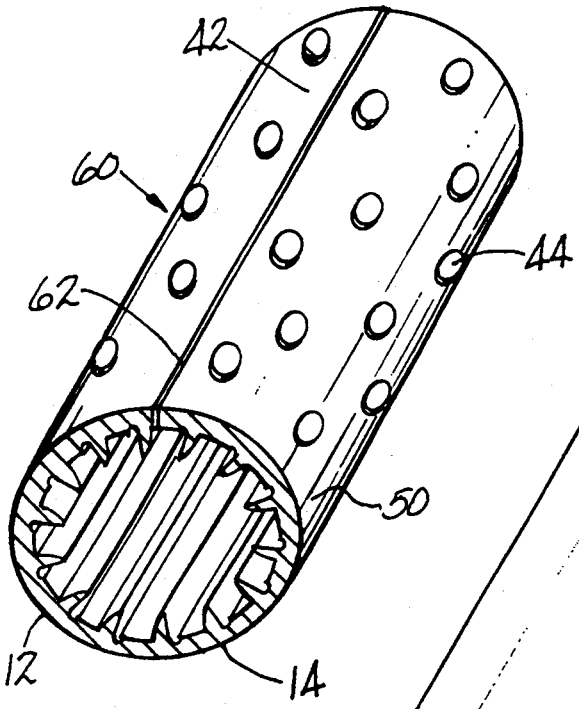
FIG. 9 shows in isometric view an absorption tube formed with the enhancements of the invention.

FIG. 9 illustrates in isometric view an absorption type heat exchange tube 60. The ductile metal strip 50 has been formed into a generally circular configuration and the longitudinal edges of the metallic strip welded together with a longitudinal weld bead 62. In the embodiment of FIG. 9, the first surface 14 forms the inner wall of the heat exchange tube 60 while the second surface 42 forms the outer wall of the heat exchange tube 60. In this embodiment, the fins are not bent and function to increase the surface area of the inside wall of the tube.

Figure 10:
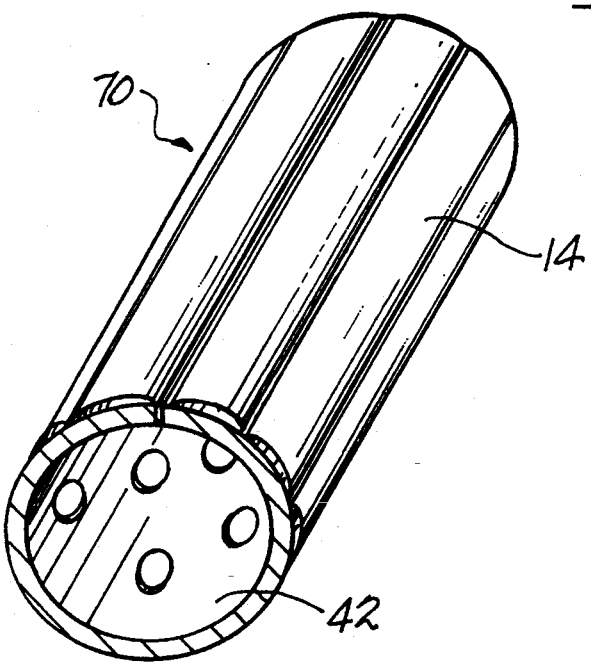
FIG. 10 shows in isometric view an evaporation tube formed with the enhancements of the invention.

FIG. 10 illustrates an evaporation type heat exchange tube 70 in which the first surface 14 forms an outside wall of the heat exchange tube 70 and the second surface 42 forms an inside wall. This type of tube is particularly suitable for applications in which a relatively warm fluid travels inside the tube and heat is transferred through the tube by nucleate boiling of an external fluid flowing along the first surface 14.

The patents and patent applications set forth in the application are intended to be incorporated herein by reference.

It is apparent that there has been provided in accordance with the present invention, a heat exchange tube which fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A heat exchange surface, comprising:

a substrate having substantially parallel rows of asymmetric vertical fins separated by channels formed on a surface thereof;

each said fin having a base at said surface and an opposing tip separated by first and second opposing sides;

said tip terminating in an off center arc such that said first side of said fin is longer than said second side of said fin; and a conduit formed in said channels at an intersection of said first side of said fin and said channel, said conduit having a width of from about 5% to about 20% of the width of said channels.

2. The heat exchange surface of claim 1 wherein said fin is bent such that the tip of said fin and a mid-point of an adjacent fin define an aperture.

3. The heat exchange surface of claim 2 wherein the fin pitch is from about 60% to about 95% of the fin height.

4. A heat exchange surface comprising:

a substrate having substantially parallel rows of asymmetric vertical fins separated by channels formed on a surface thereof;

each said fin having a base at said surface and an opposing tip separated by first and second opposing sides, said first side having an edge portion adjacent and perpendicular to said surface, the remainder of said first side being tapered to reduce said fin width;

said fin tip terminating in an off center arc such that said the first side of said fin is longer than said second side of said fin.

5. A heat exchange tube, comprising:

a ductile strip formed into a generally circular configuration with opposing longitudinal edges of said strip welded together forming a tube having opposing first and second surfaces;

a first enhancement formed on said first surface of said heat transfer tube, said first enhancement constituting substantially parallel rows of vertical fins having a base adjacent said first surface and an opposing tip, said substantially parallel rows of vertical fins separated by channels with conduits running along said channels parallel to said fins, said conduits having a width of from about 5% to about 20% of the width of said channels and located at the base of one side of said fins; and a second enhancement formed on a second surface of said tube, said second enhancement constituting parallel rows of protrusions separated by a distance effective to generate turbulence in a liquid passing along said second surface.

6. The heat exchange tube of claim 5 wherein the fin pitch is from about 60% to about 95% of the fin height.

7. The heat exchange tube of claim 5 wherein a tip of said fin opposite said first surface terminates in an off center arc such that the side of said fin adjacent said conduit is longer than the side of said fin opposite said conduit.

8. The heat exchange tube of claim 7 wherein said fin is bent such that the tip of said fin and a mid-point of an adjacent fin define an aperture.

9. The heat exchange tube of claim 8 wherein the ratio of protrusion pitch to protrusion height, P:H, is from about 3 to about 7.

10. The heat exchange tube of claim 9 wherein said parallel rows of protrusions form an angle of from about 40° to about 50° relative to the direction of flow of said liquid.

11. The heat exchange tube of claim 8 wherein said first surface forms an outer wall of said heat exchange tube.

12. The heat exchange tube of claim 7 wherein said first surface forms an outer wall of said heat exchange tube.

* * * * *